US005344553A

United States Patent [19]

Shih

[11] Patent Number: 5,344,553

[45] Date of Patent: Sep. 6, 1994

[54] UPGRADING OF A HYDROCARBON FEEDSTOCK UTILIZING A GRADED, MESOPOROUS CATALYST SYSTEM

[75] Inventor: Stuart S. Shih, Cherry Hill, N.J.

[73] Assignee: Mobil Oil Corporation, Fairfax, Va.

[21] Appl. No.: 20,946

[22] Filed: Feb. 22, 1993

[51] Int. Cl.[5] ..... C10G 65/04

[52] U.S. Cl. ..... 208/49; 208/210; 208/213; 208/251 H

[58] Field of Search ..... 208/49, 210, 213, 251 H

[56] References Cited

U.S. PATENT DOCUMENTS

| | | | |
|---|---|---|---|
| Re. 29,948 | 3/1979 | Dwyer et al. | 208/110 |
| 2,882,243 | 4/1959 | Milton | 252/455 |
| 2,882,244 | 4/1959 | Milton | 252/455 |
| 3,130,007 | 4/1964 | Breck | 23/113 |
| 3,247,195 | 4/1966 | Kerr | 260/242 |
| 3,314,752 | 4/1967 | Kerr | 23/113 |
| 3,696,027 | 10/1972 | Bridge | 209/251 H |
| 3,702,886 | 11/1972 | Argauer et al. | 423/328 |
| 3,709,979 | 1/1973 | Chu | 423/328 |
| 3,832,449 | 8/1974 | Rosinski et al. | 423/328 |
| 3,941,871 | 3/1976 | Dwyer et al. | 423/326 |
| 3,972,983 | 8/1976 | Ciric | 423/328 |
| 4,016,067 | 4/1977 | Fischer et al. | 208/210 |
| 4,016,245 | 4/1977 | Plank et al. | 423/328 |
| 4,061,724 | 12/1977 | Grose et al. | 423/335 |
| 4,073,865 | 2/1978 | Flanigen et al. | 423/339 |
| 4,076,842 | 2/1978 | Plank et al. | 423/328 |
| 4,104,294 | 8/1978 | Grose et al. | 260/448 |
| 4,176,090 | 11/1979 | Vaughan et al. | 252/455 Z |
| 4,216,188 | 8/1980 | Shabria et al. | 423/118 |
| 4,248,739 | 2/1981 | Vaughan et al. | 252/455 R |
| 4,306,964 | 12/1981 | Angevine | 208/210 |
| 4,310,440 | 1/1982 | Wilson et al. | 252/435 |
| 4,367,163 | 1/1983 | Pinnavaia et al. | 252/455 R |
| 4,431,526 | 2/1984 | Simpson et al. | 208/210 |
| 4,752,376 | 6/1988 | Pachano et al. | 208/210 |
| 4,831,006 | 5/1989 | Aufdembrink | 502/242 |
| 4,859,648 | 8/1989 | Landis et al. | 502/242 |
| 4,880,611 | 11/1989 | von Ballmoos et al. | 423/306 |
| 5,183,561 | 1/1993 | Kresge et al. | 208/251 R |

OTHER PUBLICATIONS

Meier, W. M. et al., Atlas of Zeolite Structure Types, 2nd rev. ed., Butterworths, 18–19 (1987).

Moore, P. B. et al. "An X-ray structural study of cacoxenite, a mineral phosphate," NATURE, vol. 306, 356–358 (1983).

Davis, M. E. et al., "VPI-5: The first molecular sieve with pores larger than 10 Angstroms," ZEOLITES, vol. 8, 362–366 (1988).

Szostak, R. et al., "Ultralarge Pore Molecular Sieves: Characterization of the 14 Anstroms Pore Mineeral, Cacoxenite," ZEOLITES: FACTS, FIGURES, FUTURE, Elseview Science Pub. B.V., Amsterdam, 439–446 (1989).

*Primary Examiner*—Helane Myers
*Assistant Examiner*—Walter D. Griffin
*Attorney, Agent, or Firm*—Alexander J. McKillop; Dennis P. Santini; Lori F. Cuomo

[57] ABSTRACT

There is provided a process for upgrading hydrocarbon feedstocks, such as resids or shale oil. The process uses a catalyst comprising at least one Group VIA or Group VIII metal, such as nickel and molybdenum, and an ultra-large pore oxide material. The ultra-large pore oxide material is used in decreasing pore size from top to bottom of the reactor.

19 Claims, 3 Drawing Sheets

UPGRADING OF A HYDROCARBON FEEDSTOCK UTILIZING A GRADED, MESOPOROUS CATALYST SYSTEM

FIELD OF THE INVENTION

Described herein is a process for upgrading hydrocarbon feedstocks, such as resids or shale oil.

BACKGROUND OF THE INVENTION

Zeolites, both natural and synthetic, have been demonstrated in the past to have catalytic properties for various types of hydrocarbon conversion. Certain zeolitic materials are ordered, porous crystalline aluminosilicates having a definite crystalline structure as determined by X-ray diffraction, within which there are a large number of smaller cavities which may be interconnected by a number of still smaller channels or pores. The pore systems of other zeolites lack cavities, and these systems consist essentially of unidimensional channels which extend throughout the crystal lattice. Since the dimensions of zeolite pores are such as to accept for adsorption molecules of certain dimensions while rejecting those of larger dimensions, these materials are known as "molecular sieves" and are utilized in a variety of ways to take advantage of these properties.

Such molecular sieves, both natural and synthetic, include a wide variety of positive ion-containing crystalline silicates. These silicates can be described as a rigid three-dimensional framework of $SiO_4$ and, optionally, Periodic Table Group IIIB element oxide, e.g., $AlO_4$, in which the tetrahedra are cross-linked by the sharing of oxygen atoms whereby the ratio of the total Group IIIB element, e.g., aluminum, and Group IVB element, e.g., silicon, atoms to oxygen atoms is 1:2. The electrovalence of the tetrahedra containing the Group IIIB element, e.g., aluminum, is balanced by the inclusion in the crystal of a cation, for example, an alkali metal or an alkaline earth metal cation. This can be expressed wherein the ratio of the Group IIIB element, e.g., aluminum, to the number of various cations, such as $Ca^{+2}$, $Sr^{+2}$, $Na^{+}$, $K^{+}$, or $Li^{+}$, is equal to unity. One type of cation may be exchanged either entirely or partially with another type of cation utilizing ion exchange techniques in a conventional manner. By means of such cation exchange, it has been possible to vary the properties of a given silicate by suitable selection of the cation. The spaces between the tetrahedra are occupied by molecules of water prior to dehydration.

Prior art techniques have resulted in the formation of a great variety of synthetic zeolites. Many of these zeolites have come to be designated by letter or other convenient symbols, as illustrated by zeolite A (U.S. Pat. No. 2,882,243); zeolite X (U.S. Pat. No. 2,882,244); zeolite Y (U.S. Pat. No. 3,130,007); zeolite ZK-5 (U.S. Pat. No. 3,247,195); zeolite ZK-4 (U.S. Pat. No. 3,314,752); zeolite ZSM-5 (U.S. Pat. No. 3,702,886); zeolite ZSM-11 (U.S. Pat. No. 3,709,979); zeolite ZSM-12 (U.S. Pat. No. 3,832,449); zeolite ZSM-20 (U.S. Pat. No. 3,972,983); ZSM-35 (U.S. Pat. No. 4,016,245); and zeolite ZSM-23 (U.S. Pat. No. 4,076,842), merely to name a few.

The $SiO_2/Al_2O_3$ ratio of a given zeolite is often variable. For example, zeolite X can be synthesized with $SiO_2/Al_2O_3$ ratios of from 2 to 3; zeolite Y, from 3 to about 6. In some zeolites, the upper limit of the $SiO_2/Al_2O_3$ ratio is unbounded. ZSM-5 is one such example wherein the $SiO_2/Al_2O_3$ ratio is at least 5 and up to the limits of present analytical measurement techniques. U.S. Pat. No. 3,941,871 (U.S. Pat. No. Re. 29,948) discloses a porous crystalline silicate made from a reaction mixture containing no deliberately added alumina in the recipe and exhibiting the X-ray diffraction pattern characteristic of ZSM-5. U.S. Pat. Nos. 4,061,724; 4,073,865 and 4,104,294 describe crystalline silicates of varying alumina and metal content.

Aluminum phosphates are taught in U.S. Pat. Nos. 4,310,440 and 4,385,994, for example. These aluminum phosphate materials have essentially electroneutral lattices. These lattices may be described in terms of alternating $AlO_4$ and $PO_4$ tetrahedra. An example of such an aluminum phosphate is a material designated as $AlPO_4$-5.

Details of the structure of $AlPO_4$-5 are given by Meier and Olson in, *Atlas of Zeolite Structure Types,* 2nd rev. ed., published on behalf of the Structure Commission of the International Zeolite Association by Butterworths (1987). More particularly, Meier and Olson indicate that $AlPO_4$-5, also designated as AFI, is a material having pore windows formed by 12 tetrahedral members, these windows being about 7.3 Angstroms in diameter.

Of the siliceous zeolites discussed hereinabove, zeolites X and Y have the largest pore diameter and overall pore volume. Zeolites X and Y are synthetic analogues of the naturally ocurring zeolite, faujasite. Details of the structure of faujasite are also given by Meier and Olson, ibid. More particularly, Meier and Olson indicate that faujasite, also designated as FAU, is a material having pore windows formed by 12 tetrahedral members, these windows being about 7.4 Angstroms in diameter. For the purposes of the present disclosure, the terms, siliceous zeolite and siliceous oxide, are defined as materials wherein at least 50 mole percent of the oxides thereof, as determined by elemental analysis, are silica. The pore volume of faujasite is believed to be about 0.26 cc/g.

An oxide material with even larger pores than faujasite and $AlPO_4$-5 is a material designated as VPI-5. The structure of VPI-5 is described by Davis et al in an article entitled, "VPI-5: The first molecular sieve with pores larger than 10 Angstroms", *Zeolites,* Vol. 8, 362–366 (1988). As indicated by Davies et al, VPI-5 has pore windows formed by 18 tetrahedral members of about 12–13 Angstroms in diameter. A material having the same structure as VPI-5 is designated MCM-9 and is described in U.S. Pat. No. 4,880,611.

A naturally occurring, highly hydrated basic ferric oxyphosphate mineral, cacoxenite, is reported by Moore and Shen, *Nature,* Vol. 306, No. 5941, 356–358 (1983) to have a framework structure containing very large channels with a calculated free pore diameter of 14.2 Angstroms. R. Szostak et al., *Zeolites: Facts, Figures, Future,* Elsevier Science Publishers B.V. (1989), present work showing cacoxenite as being very hydrophilic, i.e., adsorbing non-polar hydrocarbons only with great difficulty. Their work also shows that thermal treatment of cacoxenite causes an overall decline in X-ray peak intensity.

In layered materials, the interatomic bonding in two directions of the crystalline lattice is substantially different from that in the third direction, resulting in a structure that contains cohesive units resembling sheets. Usually, the bonding between the atoms within these sheets is highly covalent, while adjacent layers are held together by ionic forces or van der Waals interactions. These latter forces can frequently be neutralized by relatively modest chemical means, while the bonding between atoms within the layers remains intact and unaffected.

Certain layered materials, which contain layers capable of being spaced apart with a swelling agent, may be pillared to provide materials having a large degree of porosity. Examples of such layered materials include clays. Such clays may be swollen with water, whereby the layers of the clay are spaced apart by water molecules. Other layered materials are not swellable with water, but may be swollen with certain organic swelling agents such as amines and quaternary ammonium compounds. Examples of such non-water swellable layered materials are described in U.S. Pat. No. 4,859,648 and include trititanates, perovskites and layered silicates, such as magadiite and kenyaite. Another example of a non-water swellable layered material, which can be swollen with certain organic swelling agents, is a vacancy-containing titanometallate material, as described in U.S. Pat. No. 4,831,006.

Once a layered material is swollen, the material may be pillared by interposing a thermally stable substance, such as silica, between the spaced apart layers. The aforementioned U.S. Pat. Nos. 4,831,006 and 4,859,648 describe methods for pillaring the non-water swellable layered materials described therein and are incorporated herein by reference for definition of pillaring and pillared materials.

Other patents teaching pillaring of layered materials and the pillared products include U.S. Pat. Nos. 4,216,188; 4,248,739; 4,176,090 and 4,367,163; and European Patent Application 205,711.

Heavy oils, petroleum residua, and bitumen derived from tar sand or oil shales contain asphaltenes and trace metals (nickel, vanadium, etc), which are poisonous to the catalysts used in refining processes. Consequently, demetalation and asphaltene conversion are two important reactions for the upgrading of those heavy hydrocarbons.

Asphaltenes and metal-containing molecules are bulky and therefore not readily accessible to the surface of conventional zeolite pores. Ultra-large pore materials with pore openings as large as 40 Angstroms would be attractive for the metal removal and asphaltene conversion.

Retorted shale oil contains trace metals, such as arsenic, iron, and nickel, which can cause permanent deactivation of the down-stream upgrading catalysts. In addition, shale oil is highly olefinic and rich in nitrogen-containing compounds and sulfur-containing compounds. Olefins, without saturation, can result in a rapid temperature rise in the down-stream upgrading processes. Olefins can also facilitate bed-plugging due to the coke formation at elevated temperature. Consequently, it is desirable to maximize catalytic activities for metal removal, desulfurization, olefin saturation, and heteroatom removal.

SUMMARY

Figure 1:
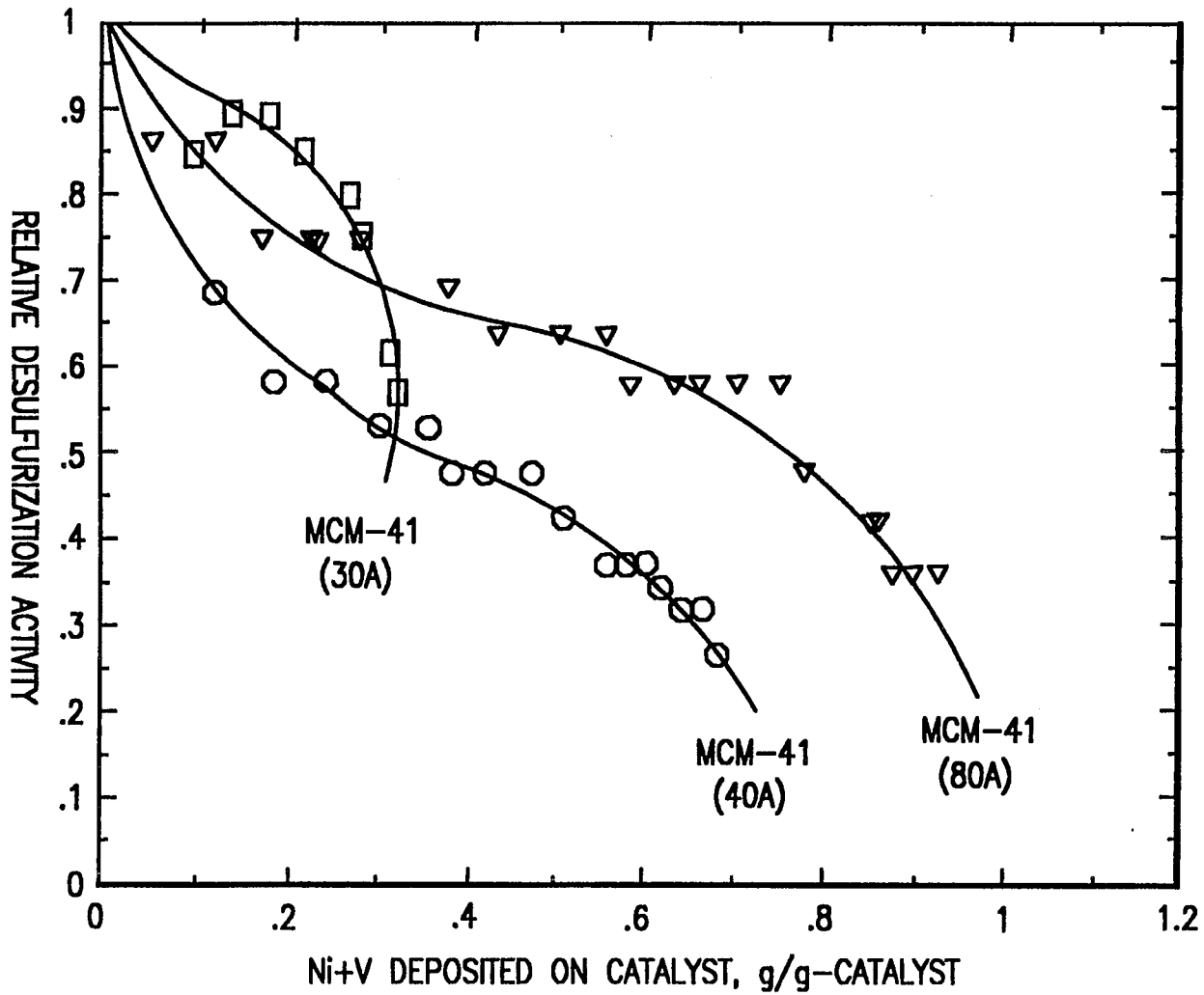
FIG. 1 is a plot showing the effect of metals deposition on desulfurization.

In accordance with the present invention, there has now been discovered an improved process for resid upgrading. Catalysts prepared with the mesoporous material described herein are effective for resid demetalation as described in U.S. Pat. No. 5,183,561, incorporated herein in its entirety by reference. It has now been found that capacity or tolerance for nickel and vanadium deposition on the catalyst increases with the pore size of the mesoporous material. Desulfurization and asphaltenes conversion are also affected by the pore size of the mesoporous material. The present invention relates to a unique catalyst system for resid upgrading with a gradient of the mesoporous material pore size decreasing from the top to bottom of the reactor.

The invention therefore includes a process for upgrading a hydrocarbon feedstock, said process comprising contacting said hydrocarbon feedstock with a catalyst in a first reaction zone, said catalyst comprising at least one Group VIA or Group VIIIA metal and an inorganic, porous crystalline phase material having, after calcination, an X-ray diffraction pattern with at least one peak at a d-spacing greater than about 18 Angstrom Units with a relative intensity of 100 and a benzene adsorption capacity of greater than 15 grams benzene per 100 grams of said material at 50 torr and 25 C, wherein said material has a pore size in the range of about 60 to about 120 Angstroms;

contacting the effluent from said first reaction zone with a catalyst in a second reaction zone said catalyst comprising at least one Group VIA or Group VIIIA metal and an inorganic, porous crystalline phase material having, after calcination, an X-ray diffraction pattern with at least one peak at a d-spacing greater than about 18 Angstrom Units with a relative intensity of 100 a benzene adsorption capacity of greater than 15 grams benzene per 100 grams of said material at 50 torr and 25 C, and wherein said material has a pore size in the range of about 40 to less than about 60 Angstroms; and contacting the effluent from said second reaction zone with a catalyst in a third reaction zone said catalyst comprising at least one Group VIA or Group VIII metal and an inorganic, porous crystalline phase material having, after calcination, an X-ray diffraction pattern with at least one peak at a d-spacing greater than about 18 Angstrom Units with a relative intensity of 100 and a benzene adsorption capacity of greater than 15 grams benzene per 100 grams of said material at 50 torr and 25 C, and wherein said material has a pore size in the range of about 20 to less than about 40 Angstroms.

EMBODIMENTS

The crystalline mesoporous oxide material described herein and in U.S. Pat. No. 5,102,643, incorporated herein in its entirety by reference, may be an inorganic, porous material having a pore size of at least about 13 Angstroms. More particularly, this pore size may be within the range of from about 13 Angstroms to about 200 Angstroms. Certain of these novel crystalline compositions may exhibit a hexagonal electron diffraction pattern that can be indexed with a $d_{100}$ value greater than about 18 Angstroms, and a benzene adsorption capacity of greater than about 15 grams benzene/100 grams crystal at 50 torr and 25° C., as described in U.S. Pat. No. 5,098,684, incorporated herein in its entirety by reference. The hexagonal form is referred to as MCM-41.

As demonstrated hereinafter, the inorganic, non-layered mesoporous crystalline material described herein may have the following composition:

$$M_{n/q}(W_aX_bY_cZ_dO_h)$$

wherein W is a divalent element, such as a divalent first row transition metal, e.g., manganese, cobalt and iron, and/or magnesium, preferably cobalt; X is a trivalent element, such as aluminum, boron, iron and/or gallium, preferably aluminum; Y is a tetravalent element such as silicon and/or germanium, preferably silicon; Z is a pentavalent element, such as phosphorus; M is one or more ions, such as, for example, ammonium, Group IA, IIA and VIIB ions, usually hydrogen, sodium and/or fluoride ions; n is the charge of the composition excluding M expressed as oxides; q is the weighted molar average valence of M; n/q is the number of moles or mole fraction of M; a, b, c, and d are mole fractions of W, X, Y and Z, respectively; h is a number of from 1 to 2.5; and $(a+b+c+d)=1$.

A preferred embodiment of the above crystalline material is when $(a+b+c)$ is greater than d, and $h=2$. A further embodiment is when a and $d=0$, and $h=2$.

In the as-synthesized form, this material may have a composition, on an anhydrous basis, expressed empirically as follows:

$$rRM_{n/q}(W_aX_bY_cZ_dO_h)$$

wherein R is the total organic material not included in M as an ion, and r is the coefficient for R, i.e., the number of moles or mole fraction of R.

The M and R components are associated with the material as a result of their presence during crystallization, and are easily removed or, in the case of M, replaced by post-crystallization methods hereinafter more particularly described.

To the extent desired, the original M, e.g., sodium or chloride, ions of the as-synthesized material described herein can be replaced in accordance with techniques well known in the art, at least in part, by ion exchange with other ions. Examples of such replacing ions include metal ions, hydrogen ions, hydrogen precursor, e.g., ammonium, ions and mixtures thereof. Particular examples of such ions are those which tailor the catalytic activity for certain hydrocarbon conversion reactions. Replacing ions include hydrogen, rare earth metals and metals of Groups IA (e.g., K), IIA (e.g., Ca), VIIA (e.g., Mn), VIIIA (e.g., Ni), IB (e.g., Cu), IIB (e.g., Zn), IIIB (e.g., In), IVB (e.g., Sn), and VIIB (e.g., F) of the Periodic Table of the Elements (Sargent-Welch Scientific Co. Cat. No. S-18806, 1979) and mixtures thereof.

The crystalline (i.e., meant here as having sufficient order to provide a diffraction pattern such as, for example, by X-ray, electron or neutron diffraction, following calcination with at least one peak) mesoporous material described herein may be characterized by its heretofore unknown structure, including extremely large pore windows, and high sorption capacity. The term "mesoporous" is used here to indicate crystals having pores within the range of from about 13 Angstroms to about 200 Angstroms. The materials described herein may have uniform pores within the range of from about 13 Angstroms to about 200 Angstroms, more usually from about 15 Angstroms to about 100 Angstroms. For the purposes of this disclosure, a working definition of "porous" is a material that adsorbs at least 1 gram of a small molecule, such as Ar, $N_2$, n-hexane or cyclohexane, per 100 grams of the solid.

The mesoporous oxide material described herein can be distinguished from other porous inorganic solids by the regularity of its large open pores, whose pore size is greater than that of zeolites, but whose regular arrangement and uniformity of size (pore size distribution within a single phase of, for example, ±25%, usually ±15% or less of the average pore size of that phase) resemble those of zeolites. Certain forms of this material appear to have a hexagonal arrangement of large open channels that can be synthesized with open internal diameters from about 13 Angstroms to about 200 Angstroms. These forms are referred to herein as hexagonal forms. The term "hexagonal" is intended to encompass not only materials that exhibit mathematically perfect hexagonal symmetry within the limits of experimental measurement, but also those with significant observable deviations from that ideal state. A working definition as applied to the microstructure of the hexagonal form of the present mesoporous material would be that most channels in the material would be surrounded by six nearest neighbor channels at roughly the same distance. Defects and imperfections may cause significant numbers of channels to violate this criterion to varying degrees, depending on the quality of the material's preparation. Samples which exhibit as much as ±25% random deviation from the average repeat distance between adjacent channels still clearly give recognizable images of the hexagonal form of the present ultra-large pore materials. Comparable variations are also observed in the $d_{100}$ values from the electron diffraction patterns.

To illustrate the nature of the mesoporous material described herein, samples of these materials may be studied by transmission electron microscopy (TEM). TEM is a technique used to reveal the microscopic structure of materials, including crystalline materials.

In order to illuminate the microstructure of materials by TEM, samples must be thin enough for an electron beam to pass through them, generally about 500–1000 Angstrom units or so thick. The crystal morphology of the present materials usually requires that they be prepared for study by ultramicrotomy. While time consuming, this technique of sample preparation is quite familiar to those skilled in the art of electron microscopy. The materials may be embedded in a resin, e.g., a commercially available low viscosity acrylic resin L. R. WHITE (hard), which is then cured at about 80° C for about 1½ hours. Thin sections of the block may be cut on an ultramicrotome using a diamond knife and sections in the thickness range 500–1000 Angstrom units may be collected on fine mesh electron microscope support grids. An LKB model microtome with a 45° C. diamond knife edge may be used; the support grids may be 400 mesh copper grids. After evaporation of a thin carbon coating on the sample to prevent charging in the microscope (light gray color on a white sheet of paper next to the sample in the evaporator), the samples are ready for examination in the TEM.

High resolution TEM micrographs show projections of structure along the direction that the sample is viewed. For this reason, it is necessary to have a sample in specific orientations to see certain details of the microstructure of the material. For crystalline materials, these orientations are most easily chosen by observing the electron diffraction pattern (EDP) that is produced simultaneously with the electron microscope image.

Such EDP's are readily produced on modern TEM instruments using, e.g., the selected area field limiting aperture technique familiar to those skilled in the art of electron microscopy. When an EDP with the desired arrangement of diffraction spots is observed, the corresponding image of the crystal giving that EDP will reveal details of the microstructure along the direction of projection indicated by the EDP. In this way, different projections of a crystal's structure can be observed and identified using TEM.

In order to observe the salient features of the hexagonal form of the present mesoporous material, it is necessary to view the material in an orientation wherein the corresponding EDP gives a hexagonal arrangement of diffraction spots from a single individual crystal. If multiple crystals are present within the field limiting aperture, overlapping diffraction patterns will occur that can be quite difficult to interpret. The number of diffraction spots observed depends to a degree upon the regularity of the crystalline arrangement in the material, among other things. At the very least, however, the inner ring of bright spots should be observed to obtain a good image. Individual crystals can be manipulated by specimen tilt adjustments on the TEM until this orientation is achieved. More often, it is easier to take advantage of the fact that the specimen contains many randomly oriented crystals and to simply search through the sample until a crystal giving the desired EDP (and hence orientation) is located.

Microtomed samples of materials may be examined by the techniques described above in a JEOL 200 CX transmission electron microscope operated at 200,000 volts with an effective 2 Angstrom objective aperture in place. The instrument has a point-to-point resolution of 4.5 Angstroms. Other experimental arrangements familiar to one skilled in the art of high resolution (phase contrast) TEM could be used to produce equivalent images provided care is taken to keep the objective lens on the underfocus (weak lens) side of the minimum contrast lens current setting.

The application of the above-mentioned TEM techniques to particular samples is described in Example 23 of the aforementioned U.S. Pat. No. 5,098,684.

The most regular preparations of the hexagonal form of the present mesoporous material give an X-ray diffraction pattern with a few distinct maxima in the extreme low angle region. The positions of these peaks approximately fit the positions of the hkO reflections from a hexagonal lattice. The X-ray diffraction pattern, however, is not always a sufficient indicator of the presence of these materials, as the degree of regularity in the microstructure and the extent of repetition of the structure within individual particles affect the number of peaks that will be observed. Indeed, preparations with only one distinct peak in the low angle region of the X-ray diffraction pattern have been found to contain substantial amounts of the present material in them. Other techniques to illustrate the microstructure of this material are transmission electron microscopy and electron diffraction. Properly oriented specimens of the hexagonal form of the present material show a hexagonal arrangement of large channels and the corresponding electron diffraction pattern gives an approximately hexagonal arrangement of diffraction maxima. The $d_{100}$ spacing of the electron diffraction patterns is the distance between adjacent spots on the hkO projection of the hexagonal lattice and is related to the repeat distance $a_0$ between channels observed in the electron micrographs through the formula $d_{100}=a_0\sqrt{3}/2$. This $d_{100}$ spacing observed in the electron diffraction patterns corresponds to the d-spacing L0 of a low angle peak in the X-ray diffraction pattern of the material. The most highly ordered preparations of the material obtained so far have 20–40 distinct spots observable in the electron diffraction patterns. These patterns can be indexed with the hexagonal hkO subset of unique reflections of 100, 110, 200, 210, etc., and their symmetry-related reflections.

In its calcined form, the crystalline mesoporous material described herein may be further characterized by an X-ray diffraction pattern with at least one peak at a position greater than about 18 Angstrom Units d-spacing (4.909 degrees two-theta for Cu K-alpha radiation) which corresponds to the $d_{100}$ value of the electron diffraction pattern of the material, and an equilibrium benzene adsorption capacity of greater than about 15 grams benzene/100 grams crystal at 50 torr and 25° C. (basis: crystal material having been treated in an attempt to insure no pore blockage by incidental contaminants, if necessary).

The equilibrium benzene adsorption capacity characteristic of this material is measured on the basis of no pore blockage by incidental contaminants. For instance, the sorption test will be conducted on the crystalline material phase having any pore blockage contaminants and water removed by ordinary methods. Water may be removed by dehydration techniques, e.g., thermal treatment. Pore blocking inorganic amorphous materials, e.g., silica, and organics may be removed by contact with acid or base or other chemical agents such that the detrital material will be removed without detrimental effect on the mesoporous crystal described herein.

Certain of the calcined crystalline non-layered materials described herein may be characterized by an X-ray diffraction pattern with at least two peaks at positions greater than about 10 Angstrom Units d-spacing (8.842 degrees two-theta for Cu K-alpha radiation), at least one of which is at a position greater than about 18 Angstrom Units d-spacing, and no peaks at positions less than about 10 Angstrom units d-spacing with relative intensity greater than about 20% of the strongest peak. The X-ray diffraction pattern of calcined materials described herein may have no peaks at positions less than about 10 Angstrom units d-spacing with relative intensity greater than about 10% of the strongest peak. In any event, at least one peak in the X-ray diffraction pattern will have a d-spacing that corresponds to the $d_{100}$ value of the electron diffraction pattern of the material.

The calcined inorganic, non-layered crystalline material described herein may have a pore size of about 13 Angstroms or greater, as measured by physisorption measurements, hereinafter more particularly set forth. It will be understood that pore size refers to the diameter of pore. The pores of the present hexagonal form of these materials are believed to be essentially cylindrical.

The following description provides examples of how physisorption measurements, particularly argon physisorption measurements, may be taken. Examples 22(a) and 22(b) of the aforementioned U.S. Pat. No. 5,098,684 provide demonstrations of these measurements as applied to particular samples.

ARGON PHYSISORPTION FOR PORE SYSTEMS UP TO ABOUT 60 ANGSTROMS DIAMETER

To determine the pore diameters of products with pores up to about 60 Angstroms in diameter, 0.2 gram samples of the products may be placed in glass sample tubes and attached to a physisorption apparatus as described in U.S. Pat. No. 4,762,010, which is incorporated herein by reference.

The samples may be heated to 300° C. for 3 hours in vacuo to remove adsorbed water. Thereafter, the samples may be cooled to 87° K. by immersion of the sample tubes in liquid argon. Metered amounts of gaseous argon may then be admitted to the samples in stepwise manner as described in U.S. Pat. No. 4,762,010, column 20. From the amount of argon admitted to the samples and the amount of argon left in the gas space above the samples, the amount of argon adsorbed can be calculated. For this calculation, the ideal gas law and the calibrated sample volumes may be used. (See also S. J. Gregg et al., *Adsorption, Surface Area and Porosity,* 2nd ed., Academic Press, (1982)). In each instance, a graph of the amount adsorbed versus the relative pressure above the sample, at equilibrium, constitutes the adsorption isotherm. It is common to use relative pressures which are obtained by forming the ratio of the equilibrium pressure and the vapor pressure $P_o$ of the adsorbate at the temperature where the isotherm is measured. Sufficiently small amounts of argon may be admitted in each step to generate, e.g., 168 data points in the relative pressure range from 0 to 0.6. At least about 100 points are required to define the isotherm with sufficient detail.

The step (inflection) in the isotherm indicates filling of a pore system. The size of the step indicates the amount adsorbed, whereas the position of the step in terms of $P/P_o$ reflects the size of the pores in which the adsorption takes place. Larger pores are filled at higher $P/P_o$. In order to better locate the position of the step in the isotherm, the derivative with respect to log $(P/P_o)$ is formed. The position of an adsorption peak in terms of log $(P/P_o)$ may be converted to the physical pore diameter in Angstroms by using the following formula:

$$\log(P/P_o) = \frac{K}{d - 0.38}\left(\frac{S^4}{3\,(L - D/2)^3} - \frac{S^{10}}{9\,(L - D/2)^9} - \frac{S^4}{3\,(D/2)^3} + \frac{S^{10}}{9\,(D/2)^9}\right)$$

wherein d=pore diameter in nanometers, K=32.17, S=0.2446, L=d+0.19, and D=0.57.

This formula is derived from the method of Horvath and Kawazoe (G. Horvath et al., *J. Chem. Eng. Japan,* 16, 6, 470 (1983)). The constants required for the implementation of this formula were determined from a measured isotherm of $AlPO_4$-5 and its known pore size. This method is particularly useful for microporous materials having pores of up to about 60 Angstroms in diameter.

For materials having a pore size greater than 9 Angstroms, the plot of log $(P/P_o)$ vs. the derivative of uptake may reveal more than one peak. More particularly, a peak may be observed at $P/P_o$=0.015. This peak reflects adsorption on the walls of the pores and is not otherwise indicative of the size of the pores of a given material.

A material with pore size of 39.6 Angstroms has a peak occurring at log $(P/P_o)$=−0.4 or $P/P_o$=0.4. A value of $P/P_o$ of 0.03 corresponds to 13 Angstroms pore size.

ARGON PHYSISORPTION FOR PORE SYSTEMS OVER ABOUT 60 ANGSTROMS DIAMETER

The above method of Horvath and Kawazoe for determining pore size from physisorption isotherms was intended to be applied to pore systems of up to 20 Angstroms diameter; but with some care as above detailed, its use can be extended to pores of up to 60 Angstroms diameter.

In the pore regime above 60 Angstroms diameter, however, the Kelvin equation can be applied. It is usually given as:

$$\ln(P/P_o) = \frac{-2\lambda V}{r_k RT}\cos\Theta$$

where:

λ=surface tension of sorbate
V=molar volume of sorbate
Θ=contact angle (usually taken for practical reasons to be 0)
R=gas constant
T=absolute temperature
$r_k$=capillary condensate (pore) radius
$P/P_o$=relative pressure (taken from the physisorption isotherm)

The Kelvin equation treats adsorption in pore systems as a capillary condensation phenomenon and relates the pressure at which adsorption takes place to the pore diameter through the surface tension and contact angle of the adsorbate (in this case, argon). The principles upon which the Kelvin equation are based are valid for pores in the size range 50 to 1000 Angstroms diameter. Below this range the equation no longer reflects physical reality, since true capillary condensation cannot occur in smaller pores; above this range the logarithmic nature of the equation precludes obtaining sufficient accuracy for pore size determination.

The particular implementation of the Kelvin equation often chosen for measurement of pore size is that reported by Dollimore and Heal (D. Dollimore and G. R. Heal, *J. Applied Chem,* 14, 108 (1964)). This method corrects for the effects of the surface layer of adsorbate on the pore wall, of which the Kelvin equation proper does not take account, and thus provides a more accurate measurement of pore diameter. While the method of Dollimore and Heal was derived for use on desorption isotherms, it can be applied equally well to adsorption isotherms by simply inverting the data set.

X-ray diffraction data were collected on a Scintag PAD X automated diffraction system employing theta-theta geometry, Cu K-alpha radiation, and an energy dispersive X-ray detector. Use of the energy dispersive X-ray detector eliminated the need for incident or diffracted beam monochromators. Both the incident and diffracted X-ray beams were collimated by double slit incident and diffracted collimation systems. The slit sizes used, starting from the X-ray tube source, were 0.5, 1.0, 0.3 and 0.2 mm, respectively. Different slit systems may produce differing intensities for the peaks. The mesoporous materials described herein that have the largest pore sizes may require more highly collimated incident X-ray beams in order to resolve the low angle peak from the transmitted incident X-ray beam.

The diffraction data were recorded by step-scanning at 0.04 degrees of two-theta, where theta is the Bragg angle, and a counting time of 10 seconds for each step. The interplanar spacings, d's, were calculated in Angstrom units (A), and the relative intensities of the lines, $I/I_o$, where $I_o$ is one-hundredth of the intensity of the strongest line, above background, were derived with the use of a profile fitting routine. The intensities were uncorrected for Lorentz and polarization effects. The relative intensities are given in terms of the symbols vs=very strong (75–100), s=strong (50–74), m=medium (25–49) and w=weak (0–24). It should be understood that diffraction data listed as single lines may consist of multiple overlapping lines which under certain conditions, such as very high experimental resolution or crystallographic changes, may appear as resolved or partially resolved lines. Typically, crystallographic changes can include minor changes in unit cell parameters and/or a change in crystal symmetry, without a substantial change in structure. These minor effects, including changes in relative intensities, can also occur as a result of differences in cation content, framework composition, nature and degree of pore filling, thermal and/or hydrothermal history, and peak width/shape variations due to particle size/shape effects, structural disorder or other factors known to those skilled in the art of X-ray diffraction.

The equilibrium benzene adsorption capacity may be determined by contacting the mesoporous material described herein, after dehydration or calcination at, for example, about 540° C. for at least about one hour and other treatment, if necessary, in an attempt to remove any pore blocking contaminants, at 25° C. and 50 torr benzene until equilibrium is reached. The weight of benzene sorbed is then determined as more particularly described hereinafter.

The mesoporous material described herein when used as a catalyst component may be subjected to treatment to remove part or all of any organic constituent. The present composition can also be used as a catalyst component in intimate combination with a hydrogenating component such as tungsten, vanadium, molybdenum, rhenium, nickel, cobalt, chromium, manganese, or a noble metal such as platinum or palladium or mixtures thereof where a hydrogenation- dehydrogenation function is to be performed. Such component can be in the composition by way of co-crystallization, exchanged into the composition to the extent a Group IIIB element, e.g., aluminum, is in the structure, impregnated therein or intimately physically admixed therewith. Such component can be impregnated in or on to it such as, for example, by, in the case of platinum, treating the material with a solution containing a platinum metal-containing ion. Thus, suitable platinum compounds for this purpose include chloroplatinic acid, platinous chloride and various compounds containing the platinum amine complex.

The above crystalline material, especially in its metal, hydrogen and ammonium forms can be beneficially converted to another form by thermal treatment (calcination). This thermal treatment is generally performed by heating one of these forms at a temperature of at least 400° C. for at least 1 minute and generally not longer than 20 hours, preferably from about 1 to about 10 hours. While subatmospheric pressure can be employed for the thermal treatment, atmospheric pressure is desired for reasons of convenience, such as in air, nitrogen, ammonia, etc. The thermal treatment can be performed at a temperature up to about 750° C. The thermally treated product is particularly useful in the catalysis of certain hydrocarbon conversion reactions.

The crystalline material described herein, when employed as a catalyst component may be dehydrated, at least partially. This can be done by heating to a temperature in the range of 200° C. to 595° C. in an atmosphere such as air, nitrogen, etc. and at atmospheric, subatmospheric or superatmospheric pressures for between 30 minutes and 48 hours. Dehydration can also be performed at room temperature merely by placing the composition in a vacuum, but a longer time is required to obtain a sufficient amount of dehydration.

In accordance with a general method of preparation, the present crystalline material can be prepared from a reaction mixture containing sources of, for example, alkali or alkaline earth metal (M), e.g., sodium or potassium, cation, one or a combination of oxides selected from the group consisting of divalent element W, e.g., cobalt, trivalent element X, e.g., aluminum, tetravalent element Y, e.g., silicon, and pentavalent element Z, e.g., phosphorus, an organic (R) directing agent, hereinafter more particularly described, and a solvent or solvent mixture, especially water, said reaction mixture having a composition, in terms of mole ratios of oxides, within the following ranges:

| Reactants | Useful | Preferred |
|---|---|---|
| $X_2O_3/YO_2$ | 0 to 0.05 | 0.001 to 0.05 |
| $X_2O_3/(YO_2 + Z_2O_5)$ | 0.1 to 100 | 0.1 to 20 |
| $X_2O_3/(YO_2 + WO + Z_2O_5)$ | 0.1 to 100 | 0.1 to 20 |
| Solvent/$YO_2$ | 1 to 1500 | 5 to 1000 |
| $OH^-/YO_2$ | 0.01 to 10 | 0.05 to 5 |
| $(M_{2/e}O + R_{2/f}O)/(YO_2 + WO + Z_2O_5 + X_2O_3)$ | 0.01 to 20 | 0.05 to 5 |
| $M_{2/e}O/(YO_2 + WO + Z_2O_5 + X_2O_3)$ | 0 to 10 | 0.005 to 5 |

wherein e and f are the weighted average valences of M and R, respectively.

In this general synthesis method, when no Z and/or W oxides are added to the reaction mixture, the pH is critical and must be maintained at from about 10 to about 14. When Z and/or W oxides are present in the reaction mixture, the pH is not narrowly critical and may vary between about 1 and 14 for crystallization of the present invention.

The present crystalline material can be prepared by one of the following four particular methods, each with particular limitations.

A first particular method involves a reaction mixture having an $X_2O_3/YO_2$ mole ratio of from 0 to about 0.5, but an $Al_2O_3/SiO_2$ mole ratio of from 0 to 0.01, a crystallization temperature of from about 25° C. to about 250° C., preferably from about 50° C. to about 175° C., and an organic directing agent, hereinafter more particularly described, or, preferably a combination of that organic directing agent plus an additional organic directing agent, hereinafter more particularly described. This first particular method comprises preparing a reaction mixture containing sources of, for example, alkali or alkaline earth metal (M), e.g., sodium or potassium, cation if desired, one or a combination of oxides selected from the group consisting of divalent element W, e.g., cobalt, trivalent element X, e.g., aluminum, tetravalent element Y, e.g., silicon, and pentavalent element Z, e.g., phosphorus, an organic (R) directing agent, hereinafter more particularly described, and a solvent or solvent mixture, such as, for example, $C_1$–$C_6$ alcohols, $C_1$–$C_6$ diols and/or water, especially water, said reaction mixture having a composition, in terms of mole ratios of oxides, within the following ranges:

| Reactants | Useful | Preferred |
|---|---|---|
| $X_2O_3/YO_2$ | 0 to 0.5 | 0.001 to 0.5 |
| $Al_2O_3/SiO_2$ | 0 to 0.01 | 0.001 to 0.01 |
| $X_2O_3/(YO_2 + Z_2O_5)$ | 0.1 to 100 | 0.1 to 20 |
| $X_2O_3/(YO_2 + WO + Z_2O_5)$ | 0.1 to 100 | 0.1 to 20 |
| Solvent/ $(YO_2 + WO + Z_2O_5 + X_2O_3)$ | 1 to 1500 | 5 to 1000 |
| $OH^-/YO_2$ | 0 to 10 | 0 to 5 |
| $(M_{2/e}O + R_{2/f}O)/(YO_2 + WO + Z_2O_5 + X_2O_3)$ | 0.01 to 20 | 0.05 to 5 |
| $M_{2/e}O/(YO_2 + WO + Z_2O_5 + X_2O_3)$ | 0 to 10 | 0 to 5 |
| $R_{2/f}O/(YO_2 + WO + Z_2O_5 + X_2O_3)$ | 0.01 to 2.0 | 0.03 to 1.0 |

wherein e and f are the weighted average valences of M and R, respectively.

In this first particular method, when no Z and/or W oxides are added to the reaction mixture, the pH is important and must be maintained at from about 9 to about 14. When Z and/or W oxides are present in the reaction mixture, the pH is not narrowly important for synthesis of the present crystalline material. In this, as well as the following methods for synthesis of the present material, the $R_{2/f}O/(YO_2+WO+Z_2O_5+X_2O_3)$ ratio is important. When this ratio is less than 0.01 or greater than 2.0, impurity products tend to be synthesized at the expense of the present material.

A second particular method for synthesis of the present crystalline material involves a reaction mixture having an $X_2O_3/YO_2$ mole ratio of from about 0 to about 0.5, a crystallization temperature of from about 25° C. to about 250° C., preferably from about 50° C. to about 175° C., and two separate organic directing agents, i.e., the organic and additional organic directing agents, hereinafter more particularly described. This second particular method comprises preparing a reaction mixture containing sources of, for example, alkali or alkaline earth metal (M), e.g., sodium or potassium, cation if desired, one or a combination of oxides selected from the group consisting of divalent element W, e.g., cobalt, trivalent element X, e.g., aluminum, tetravalent element Y, e.g., silicon, and pentavalent element Z, e.g., phosphorus, a combination of organic directing agent and additional organic directing agent (R), each hereinafter more particularly described, and a solvent or solvent mixture, such as, for example, $C_1$–$C_6$ alcohols, $C_1$–$C_6$ diols and/or water, especially water, said reaction mixture having a composition, in terms of mole ratios of oxides, within the following ranges:

| Reactants | Useful | Preferred |
|---|---|---|
| $X_2O_3/YO_2$ | 0 to 0.5 | 0.001 to 0.5 |
| $X_2O_3/(YO_2 + Z_2O_5)$ | 0.1 to 100 | 0.1 to 20 |
| $X_2O_3/(YO_2 + WO + Z_2O_5)$ | 0.1 to 100 | 0.1 to 20 |
| Solvent/ $(YO_2 + WO + Z_2O_5 + X_2O_3)$ | 1 to 1500 | 5 to 1000 |
| $OH^-/YO_2$ | 0 to 10 | 0 to 5 |
| $(M_{2/e}O + R_{2/f}O)/(YO_2 + WO + Z_2O_5 + X_2O_3)$ | 0.01 to 20 | 0.05 to 5 |
| $M_{2/e}O/(YO_2 + WO + Z_2O_5 + X_2O_3)$ | 0 to 10 | 0 to 5 |
| $R_{2/f}O/$ | 0.1 to 2.0 | 0.12 to 1.0 |

-continued

| Reactants | Useful | Preferred |
|---|---|---|
| $(YO_2 + WO + Z_2O_5 + X_2O_3)$ | | |

wherein e and f are the weighted average valences of M and R, respectively.

In this second particular method, when no Z and/or W oxides are added to the reaction mixture, the pH is important and must be maintained at from about 9 to about 14. When Z and/or W oxides are present in the reaction mixture, the pH is not narrowly important for crystallization.

A third particular method for synthesis of the present crystalline material is where X comprises aluminum and Y comprises silicon, the crystallization temperature must be from about 25° C. to about 175° C., preferably from about 50° C. to about 150° C., and an organic directing agent, hereinafter more particularly described, or, preferably a combination of that organic directing agent plus an additional organic agent, hereinafter more particularly described, is used. This third particular method comprises preparing a reaction mixture containing sources of, for example, alkali or alkaline earth metal (M), e.g., sodium or potassium, cation if desired, one or more sources of aluminum and/or silicon, an organic (R) directing agent, hereinafter more particularly described, and a solvent or solvent mixture, such as, for example $C_1$–$C_6$ alcohols, $C_1$–$C_6$ diols and/or water, especially water, said reaction mixture having a composition, in terms of mole ratios of oxides, within the following ranges:

| Reactants | Useful | Preferred |
|---|---|---|
| $Al_2O_3/SiO_2$ | 0 to 0.5 | 0.001 to 0.5 |
| Solvent/$SiO_2$ | 1 to 1500 | 5 to 1000 |
| $OH^-/SiO_2$ | 0 to 10 | 0 to 5 |
| $(M_{2/e}O + R_{2/f}O)/(SiO_2 + Al_2O_3)$ | 0.01 to 20 | 0.05 to 5 |
| $M_{2/e}O/(SiO_2 + Al_2O_3)$ | 0 to 5 | 0 to 3 |
| $R_{2/f}O/(SiO_2 + Al_2O_3)$ | 0.01 to 2 | 0.03 to 1 |

wherein e and f are the weighted average valences of M and R, respectively.

In this third particular method, the pH is important and must be maintained at from about 9 to about 14. This method involves the following steps:

(1) Mix the organic (R) directing agent with the solvent or solvent mixture such that the mole ratio of solvent/$R_{2/f}O$ is within the range of from about 50 to about 800, preferably from about 50 to 500. This mixture constitutes the "primary template" for the synthesis method.

(2) To the primary template mixture of step (1) add the sources of oxides, e.g., silica and/or alumina such that the ratio of $R_{2/f}O/(SiO_2+Al_2O_3)$ is within the range of from about 0.01 to about 2.0.

(3) Agitate the mixture resulting from step (2) at a temperature of from about 20° C. to about 40° C., preferably for from about 5 minutes to about 3 hours.

(4) Allow the mixture to stand with or without agitation, preferably at a temperature of from about 20° C. to about 100° C., and preferably for from about 10 minutes to about 24 hours.

(5) Crystallize the product from step (4) at a temperature of from about 50° C. to about 175° C., preferably for from about 1 hour to about 72 hours. Crystallization temperatures higher in the given ranges are most preferred.

A fourth particular method for the present synthesis involves the reaction mixture used for the third particular method, but the following specific procedure with tetraethylorthosilicate the source of silicon oxide:

(1) Mix the organic (R) directing agent with the solvent or solvent mixture such that the mole ratio of solvent/$R_{2/f}O$ is within the range of from about 50 to about 800, preferably from about 50 to 500. This mixture constitutes the "primary template" for the synthesis method.

(2) Mix the primary template mixture of step (1) with tetraethylorthosilicate and a source of aluminum oxide, if desired, such that the $R_{2/f}O/SiO_2$ mole ratio is in the range of from about 0.5 to about 2.0.

(3) Agitate the mixture resulting from step (2) for from about 10 minutes to about 6 hours, preferably from about 30 minutes to about 2 hours, at a temperature of from about 0° C. to about 25° C., and a pH of less than 12. This step permits hydrolysis/polymerization to take place and the resultant mixture will appear cloudy.

(4) Crystallize the product from step (3) at a temperature of from about 25° C. to about 150° C., preferably from about 95° C. to about 110° C., for from about 4 to about 72 hours, preferably from about 16 to about 48 hours.

In each of the above general and particular methods, batch crystallization of the present crystalline material can be carried out under either static or agitated, e.g., stirred, conditions in a suitable reactor vessel, such as for example, polypropylene jars or teflon lined or stainless steel autoclaves. Crystallization may also be conducted continuously in suitable equipment. The total useful range of temperatures for crystallization is noted above for each method for a time sufficient for crystallization to occur at the temperature used, e.g., from about 5 minutes to about 14 days. Thereafter, the crystals are separated from the liquid and recovered.

When a source of silicon is used in the synthesis method, an organic silicate, such as, for example, a quaternary ammonium silicate, may be used, at least as part of this source. Non-limiting examples of such a silicate include tetramethylammonium silicate and tetraethylorthosilicate.

By adjusting conditions of the synthesis reaction for each method, like temperature, pH and time of reaction, etc., within the above limits, embodiments of the present non-layered crystalline material with a desired average pore size may be prepared. In particular, changing the pH, the temperature or the reaction time may promote formation of product crystals with different average pore size.

Non-limiting examples of various combinations of W, X, Y and Z contemplated for the first and second particular synthesis methods of the present invention include:

| W | X | Y | Z |
|---|---|---|---|
| — | Al | Si | — |
| — | Al | — | P |
| — | Al | Si | P |
| Co | Al | — | P |
| Co | Al | Si | P |

-continued

| W | X | Y | Z |
|---|---|---|---|
| — | — | Si | — |

including the combinations of W being Mg, or an element selected from the divalent first row transition metals, e.g., Mn, Co and Fe; X being B, Ga or Fe; and Y being Ge.

An organic directing agent for use in each of the above general and particular methods for synthesizing the present material from the respective reaction mixtures is an ammonium or phosphonium ion of the formula $R_1R_2R_3R_4Q^+$, i.e.:

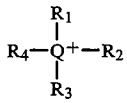

wherein Q is nitrogen or phosphorus and wherein at least one of $R_1$, $R_2$, $R_3$ and $R_4$ is aryl or alkyl of from 6 to about 36 carbon atoms, e.g., $—C_6H_{13}$, $—C_{10}H_{21}$, $—C_{16}H_{33}$ and $—C_{18}H_{37}$, or combinations thereof, the remainder of $R_1$, $R_2$, $R_3$ and $R_4$ being selected from the group consisting of hydrogen, alkyl of from 1 to 5 carbon atoms and combinations thereof. The compound from which the above ammonium or phosphonium ion is derived may be, for example, the hydroxide, halide, silicate, or mixtures thereof.

In the first and third particular methods above, it is preferred to have an additional organic directing agent and in the second particular method it is required to have a combination of the above organic directing agent and an additional organic directing agent. That additional organic directing agent is the ammonium or phosphonium ion of the above directing agent formula wherein $R_1$, $R_2$, $R_3$ and $R_4$ together or separately are selected from the group consisting of hydrogen and alkyl of 1 to 5 carbon atoms and combinations thereof. Any such combination of organic directing agents go to make up "R" and will be in molar ratio of about 100/1 to about 0.01/1, first above listed organic directing agent/additional organic directing agent.

The particular effectiveness of the presently required directing agent, when compared with other such agents known to direct synthesis of one or more other crystal structures, is believed due to its ability to function as a template in the above reaction mixture in the nucleation and growth of the desired ultra-large pore crystals with the limitations discussed above. Non-limiting examples of these directing agents include cetyltrimethylammonium, cetyltrimethylphosphonium, octadecyltrimethylphosphonium, cetylpyridinium, myristyltrimethylammonium, decyltrimethylammonium, dodecyltrimethylammonium and dimethyldidodecylammonium.

It should be realized that the reaction mixture components can be supplied by more than one source. The reaction mixture can be prepared either batchwise or continuously. Crystal size and crystallization time of the crystalline material will vary with the nature of the reaction mixture employed and the crystallization conditions.

The crystals prepared by the instant invention can be shaped into a wide variety of particle sizes. Generally speaking, the particles can be in the form of a powder, a granule, or a molded product, such as an extrudate having particle size sufficient to pass through a 2 mesh (Tyler) screen and be retained on a 400 mesh (Tyler) screen. In cases where the catalyst is molded, such as by extrusion, the crystals can be extruded before drying or partially dried and then extruded.

The present catalytic compositions are especially useful for reactions using high molecular weight, high boiling or non-distillable feeds, especially residual feeds, i.e., feeds which are essentially non-distillable or feeds which have an initial boiling point (5% point) above about 1050° F. Residual feeds which may be used with the present catalytic compositions include feeds with API gravities below about 20, usually below 15 and typically from 5 to 10 with Conradsen Carbon Contents (CCR) of at least 1% by weight and more usually at least 5% or more, e.g., 5–10%. In some resid fractions the CCR may be as high as about 20 weight percent or even higher. The aromatic contents of these feeds will be correspondingly high, as may the contents of heteroatoms such as sulfur and nitrogen, as well as metals. Aromatics content of these feeds will usually be at least 50 weight percent and typically much higher, usually at least 70 or 80 weight percent, with the balance being principally naphthenes and heterocyclics. Typical petroleum refinery feeds of this type include atmospheric and vacuum tower resids, asphalts, aromatic extracts from solvent extraction processes, e.g., phenol or furfural extraction, deasphalted oils, slop oils and residual fractions from various processes such as lube production, coking and the like. High boiling fractions with which the present catalytic compositions may be used include gas oils, such as atmospheric gas oils; vacuum gas oils; cycle oils, especially heavy cycle oil; deasphalted oils; solvent extracts, such as bright stock; heavy gas oils, such as coker heavy gas oils; and the like. The present catalytic materials may also be utilized with feeds of non-petroleum origin, for example, synthetic oils produced by coal liquefaction, Fischer-Tropsch waxes and heavy fractions and other similar materials. Another example of a particular feed is shale oil.

The present invention relates to a method for resid upgrading with a catalyst system comprising the mesoporous material described herein. The catalyst system utilizes a gradient of mesoporous material pore size, wherein the pore size decreases from the top (inlet) to bottom (outlet) of the reactor. Preferably the gradient of mesoporous material pore size is based on at least 3 pore size ranges of about 60 to about 120 Angstroms, about 40 to less than about 60 Angstroms, and about 20 to less than about 40 Angstroms. However, the gradient of mesoporous material pore size may also be based on 2 pore size ranges of about 60 to about 120 Angstroms and less than about 60 Angstroms.

Where the gradient of mesoporous material pore size is based on 3 pore size ranges used in one reactor, the ratio of the largest pore size range material to the middle pore size range material to the smallest pore size range material is 90/5/5 to 10/10/80 and preferably 20/20/60 to 10/45/45.

In a further embodiment, reactors may be used in series wherein the pore size of the mesoporous material described herein decreases from the first to the last reactor.

If more than one reactor is used in a fixed bed process, the first reactor is loaded with the mesoporous material having a very large pore size, generally in the range of about 60 to about 120 Angstroms and the last reactor is loaded with the mesoporous material having a very small pore size, generally in the range of about 30 to about 40 Angstroms. Preferably, three reactors are used in series.

Suitable reactors for use in the process of the present invention include fixed-bed, moving-bed, and fluidized-bed (ebullated-bed) reactors.

The process of the present invention maximizes demetalation, prolonges cycle length and balances demetalation and desulfurization performances.

The catalysts of the present invention may be promoted by one or more metals selected from Group VIA and Group VIII of the Periodic Table. The preferred Group VIII metals include nickel and cobalt. The preferred Group VIA metals include tungsten and molybdenum, with molybdenum preferred. The metals of Group VIII commonly known as the "noble" metals (e.g., palladium and platinum) are more expensive and more readily subject to poisoning than are iron, nickel and cobalt. Thus, the non-noble metals of Groups VIII are preferred to the noble metals thereof as a hydrogenation component. Although noble metals may, in theory, be useful in the present catalyst system, it is currently believed that in the practical applications envisioned, the overall effectiveness of catalyst systems containing non-noble metals will be much greater. It should be understood that the content of the noble metal in percent by weight would be considerably lower than the ranges set forth below for non-noble metals; a range of from about 0.1 to about 5% by weight has been found to be suitable for the noble metals. Accordingly, the following description relating to the metals content and, more specifically, the Group VIII metals content of the present catalyst system, is oriented toward the use of non-noble metals from Group VIII.

The Group VIA and Group VIII metals content of the present catalyst system may range from about 1 to about 10% of Group VIII metal and from about 2 to about 20% of Group VIA metal. A preferred amount of Group VIII metal in elemental form is between about 2% and about 10%. A preferred amount of Group VIA. metal in elemental form is between about 5% and about 20%. The foregoing amounts of metal components are given in percent by weight of the catalyst on a dry basis.

The metals content, which is defined as including both the Group VIA metal(s) and the Group VIII metal(s), most preferably nickel and molybdenum or cobalt and molybdenum, may range from about 10 to about 25% by weight, expressed in elemental form, based on total catalyst. The relative proportion of Group VIII metal to Group VIA metal in the catalyst system is not narrowly critical, but Group VIA, e.g., molybdenum, is usually utilized in greater amounts than the Group VIII metal, e.g., nickel.

The concentrations of Group VIA and Group VIII metals on the catalysts of the present invention may vary. In a preferred embodiment the Group VIA and Group VIII metal concentrations decrease with the pore size of the mesoporous material described herein. Consequently catalysts prepared with small pore mesoporous material will be impregnated with more Group VIA and Group VIII metals than catalysts prepared with large pore mesoporous material, in order to maximize catalyst activities for desulfurization, Conrad Carbon Residue (CCR) reduction and asphaltenes conversion. This embodiment results in a gradient of Group VIA and Group VIII metals in the catalyst system increasing from the top to the bottom of the reactor.

Preferably, the gradient of Group VIA and VIII metals is based on at least three weight percent ranges of about 15 to about 25% by weight, about 10 to less than about 15% by weight, and less than about 10% by weight. The combination of mesoporous material pore size gradient and Group VIA and Group VIII metals gradient may further improve the overall performance of the catalyst system of the present invention.

The metals removed from the feed may include such common metal contaminants as nickel, vanadium, iron, copper, zinc and sodium, and are often in the form of large organometallic complexes such as metal porphyrins or asphaltenes.

The feedstock employed in the present invention will normally be substantially composed of hydrocarbons boiling above 340° C. and containing a substantial quantity of asphaltic materials. Thus, the chargestock can be one having an initial or 5 percent boiling point somewhat below 340° C. provided that a substantial proportion, for example, about 70 or 80 percent by volume, of its hydrocarbon components boil above 340° C. A hydrocarbon stock having a 50 percent boiling point of about 480° C. and which contains asphaltic materials, 4 percent by weight sulfur and 50 p.p.m. nickel and vanadium is illustrative of such chargestock.

The process of the present invention may be carried out by contacting a metal contaminated feedstock with the above-described catalyst under hydrogen pressure of at least about 2860 kPa (400 psig), temperatures ranging between about 260° to 455° C. (500° to 850° F.) and liquid hourly space velocities between about 0.1 and 10 $hr^{-1}$, based on the total complement of catalyst in the system. Preferably these conditions include hydrogen pressures between about 7000 to 17000 kPa (about 1000 to 2500 psig), temperatures between about 315° to 440° C. (about 600° to 825° F.), and liquid hourly space velocities between about 0.2 and 5.0 $hr^{-1}$.

For the upgrading of feedstocks such as resids, the present catalysts are quite active for asphaltene conversion and removal of nickel and vanadium, while operating at low overall hydrogen consumptions. Especially for the upgrading of shale oils, the present catalysts are particularly active for olefin saturation, denitrogenation and removal of iron and nickel. These catalysts are also active for desulfurization and arsenic removal. In view of the high pore volume of the mesoporous catalyst component, a large volume for metals uptake is also available.

As in the case of many catalysts, it may be desired to incorporate the crystal composition with another material resistant to the temperatures and other conditions employed in organic conversion processes. Such materials include active and inactive materials and synthetic or naturally occurring zeolites as well as inorganic materials such as clays, silica and/or metal oxides such as alumina, titania and/or zirconia. The latter may be either naturally occurring or in the form of gelatinous precipitates or gels including mixtures of silica and metal oxides. Use of a material in conjunction with the crystal, i.e., combined therewith or present during synthesis of the crystal, which is active, tends to change the conversion and/or selectivity of the catalyst in certain organic conversion processes. Inactive materials suitably serve as diluents to control the amount of conversion in a given process so that products can be obtained economically and orderly without employing other means for controlling the rate of reaction. These materials may be incorporated with naturally occurring clays, e.g., bentonite and kaolin, to improve the crush strength of the catalyst under commercial operating conditions. Said materials, i.e., clays, oxides, etc., function as binders for the catalyst. It is desirable to provide a catalyst having good crush strength because in commercial use it is desirable to prevent the catalyst from breaking down into powder-like materials. These clay binders have been employed normally only for the purpose of improving the crush strength of the catalyst.

Naturally occurring clays which can be composited with the crystal include the montmorillonite and kaolin family, which families include the subbentonites, and the kaolins commonly known as Dixie, McNamee, Georgia and Florida clays or others in which the main mineral constituent is halloysite, kaolinite, dickite, nacrite, or anauxite. Such clays can be used in the raw state as originally mined or initially subjected to calcination, acid treatment or chemical modification.

In addition to the foregoing materials, the crystal can be composited with a porous matrix material such as silica-alumina, silica-magnesia, silica-zirconia, silica-thoria, silica-beryllia, silica-titania as well as ternary compositions such as silica-alumina-thoria, silica-alumina-zirconia, silica-alumina-magnesia and silica-magnesia-zirconia.

It may be desirable to provide at least a part of the foregoing matrix materials in colloidal form so as to facilitate extrusion of the bound catalyst components.

The relative proportions of finely divided crystalline material and inorganic oxide matrix vary widely, with the crystal content ranging from about 1 to about 90 percent by weight and more usually, particularly when the composite is prepared in the form of beads, in the range of about 2 to about 80 weight percent of the composite.

The following examples illustrates the process of the present invention.

CATALYSTS

Three NiMo MCM-41(65%)/$Al_2O_3$(35%) catalysts were prepared with MCM-41 materials having a pore size of about 30 Angstroms, about 40 Angstoms and about 80 Angstroms, respectively. MCM-41 (30 Angstroms) was synthesized in accordance with U.S. Pat. No. 5,108,725, incorporated herein in its entirety by reference. The MCM-41 (30 Angstroms) was $NH_4$+ exchanged. The $NH_4$+ form of MCM-41 (30 Angstroms) was extruded with alumina to 1/16 inch extrudates and crushed and sized to 14/24 mesh. The extrudates were calcined under $N_2$ for 6 hours followed by 12 hours of air calcination. The NiMo MCM-41 (30 Angstroms)/$Al_2O_3$ catalyst was prepared by co-impregnating the 65 wt. % MCM-41 (30 Angstroms)/35 wt. % $Al_2O_3$ extrudates with a solution containing nickel nitrate and ammonium heptamolybdate.

MCM-41 (40 Angstroms) was synthesized in accordance with U.S. Pat. No. 5,102,643, incorporated herein in its entirety by reference. The MCM-41 (40 Angstroms) was $NH_4$+ exchanged. The $NH_4$+ form of MCM-41 (40 Angstroms) was extruded with alumina to 1/16 inch extrudates and crushed and sized to 14/24 mesh. The extrudates were calcined under $N_2$ for 6 hours followed by 12 hours of air calcination. The NiMo MCM-41 (40 Angstroms)/$Al_2O_3$ catalyst was prepared by co-impregnating the 65 wt. % MCM-41 (40 Angstroms)/35 wt. % $Al_2O_3$ extrudates with a solution containing nickel nitrate and ammonium heptamolybdate.

MCM-41 (80 Angstroms) was synthesized in accordance with U.S. Pat. No. 5,057,296, incorporated herein in its entirety by reference. The MCM-41 (80 Angstroms) was $NH_4+$ exchanged. The $NH_4+$ form of MCM-41 (80 Angstroms) was extruded with alumina to 1/32 inch extrudates. The extrudates were calcined under $N_2$ for 6 hours followed by 12 hours of air calcination. The NiMo MCM-41 (80 Angstroms)/$Al_2O_3$ catalyst was prepared by co-impregnating the 65 wt. % MCM-41 (80 Angstroms)/35 wt. % $Al_2O_3$ extrudates with a solution containing nickel nitrate and ammonium heptamolybdate.

Properties of the three catalysts are shown in Table 1.

TABLE 1

| Fresh NiMo MCM-41 Catalyst Properties | | | |
|---|---|---|---|
| MCM-41(1) Pore Size | 30 Angstroms** | 40 Angstroms** | 80 Angstroms** |
| Chemical Analyses | | | |
| Ni, wt. % | 2.8 | 2.6 | 2.5 |
| Mo, wt. % | 5.5 | 5.1 | 5.5 |
| Physical Properties | | | |
| Packed Density, g/cc(2) | 0.515 | 0.447 | 0.432 |
| Particle Density, g/cc | 0.961 | 0.800 | NA* |
| Pore Volume, cc/g | 0.669 | 0.88 | NA* |
| Surface Area, $m^2/g$ | 567 | 645 | NA* |
| Pore Size Distributions, cc/g | | | |
| (Hg Porosimetry) | | | |
| <100 Angstroms | 0.397 | 0.323 | 0.371 |
| 100–200 Angstroms | 0.036 | 0.143 | 0.077 |
| >200 Angstroms | 0.094 | 0.160 | 0.191 |
| Total pore volume, cc/g | 0.596 | 0.626 | 0.639 |

(1)65 wt. % MCM-41 and 35 wt. % $Al_2O_3$
(2)Based on 14/24 mesh particles
*NA: not measured
**calculated as average pore size

EXAMPLE 1

The catalysts were individually evaluated in a fixed bed reactor for fresh catalyst activity. The catalysts were evaluated at 750° F., 1.0 LHSV and 1900 psig total pressure with a once through hydrogen circulation rate of 5000 SCF/BBL. The feedstock used for the fresh catalyst activity tests was Arabian light atmospheric resid having the following properties as shown in Table 2. The results of the evaluations are set forth in Table 3. The results showed that the MCM-41(30 Angstrom)-/$Al_2O_3$ catalyst was more active for desulfurization and CCR reduction than either the MCM-41(40 Angstrom)-/$Al_2O_3$ catalyst or the MCM-41(80 Angstrom)/$Al_2O_3$ catalyst. The MCM-41(80 Angstrom)/$Al_2O_3$ catalyst was very active for demetalation and asphaltenes conversion.

TABLE 2

| Feedstock Properties | |
|---|---|
| Arabian Light Atmospheric Resid | |
| Gravity, API | 18.1 |
| Hydrogen, wt. % | 11.85 |
| Sulfur, wt. % | 3.0 |
| CCR, wt. % | 7.7 |
| Asphaltenes, wt. % | 4.85 |
| KV @ 100° C., seconds | 62.37 |
| KV @ 300° F., seconds | 5.73 |
| Nickel, ppmw | 8.9 |
| Vanadium, ppmw | 34.0 |
| Iron, ppmw | 2.7 |
| Sodium, ppmw | 6.8 |
| Composition, wt. % | |
| 650° F.− | 10 |

TABLE 2-continued

| Feedstock Properties | |
|---|---|
| 650–1000° F. | 46 |
| 1000° F.+ | 35 |

TABLE 3

| Relative Fresh Catalyst Activity | | | |
|---|---|---|---|
| MCM-41 Pore Size Relative Activity | 30 Angstroms | 40 Angstroms | 80 Angstroms |
| Desulfurization | 100 | 78 | 83 |
| Demetalation | 100 | 120 | 99 |
| Asphaltenes Conversion | 100 | 92 | 162 |
| CCR Reduction | 100 | 76 | 76 |

EXAMPLE 2

The catalysts were individually evaluated in a fixed bed reactor for metals (Ni+V) deposition. The catalysts were evaluated at 750° F., 2.0 LHSV and 1900 psig. The feedstock used for the metals deposition test was Maya atmospheric resid having the following properties as shown in Table 4. Based on Ni and V contents in the products, amounts of Ni and V deposited on the catalyst were calculated and expressed as g-metals/g-catalyst (fresh catalyst basis).

TABLE 4

| Feedstock Properties | |
|---|---|
| Maya Atmospheric Resid | |
| Gravity, API | 10.9 |
| Hydrogen, wt. % | 10.89 |
| Sulfur, wt. % | 4.2 |
| CCR, wt. % | 14.98 |
| Asphaltenes, wt. % | 18.81 |
| KV @ 100° C., seconds | 137.0 |
| KV @ 300° F., seconds | 25.28 |
| Nickel, ppmw | 72 |
| Vanadium, ppmw | 360 |
| Iron, ppmw | 2.7 |
| Sodium, ppmw | 20 |
| Composition, wt. % | |
| 650° F.− | 7 |
| 650–1000° F. | 35 |
| 1000° F.+ | 52 |

Figure 2:
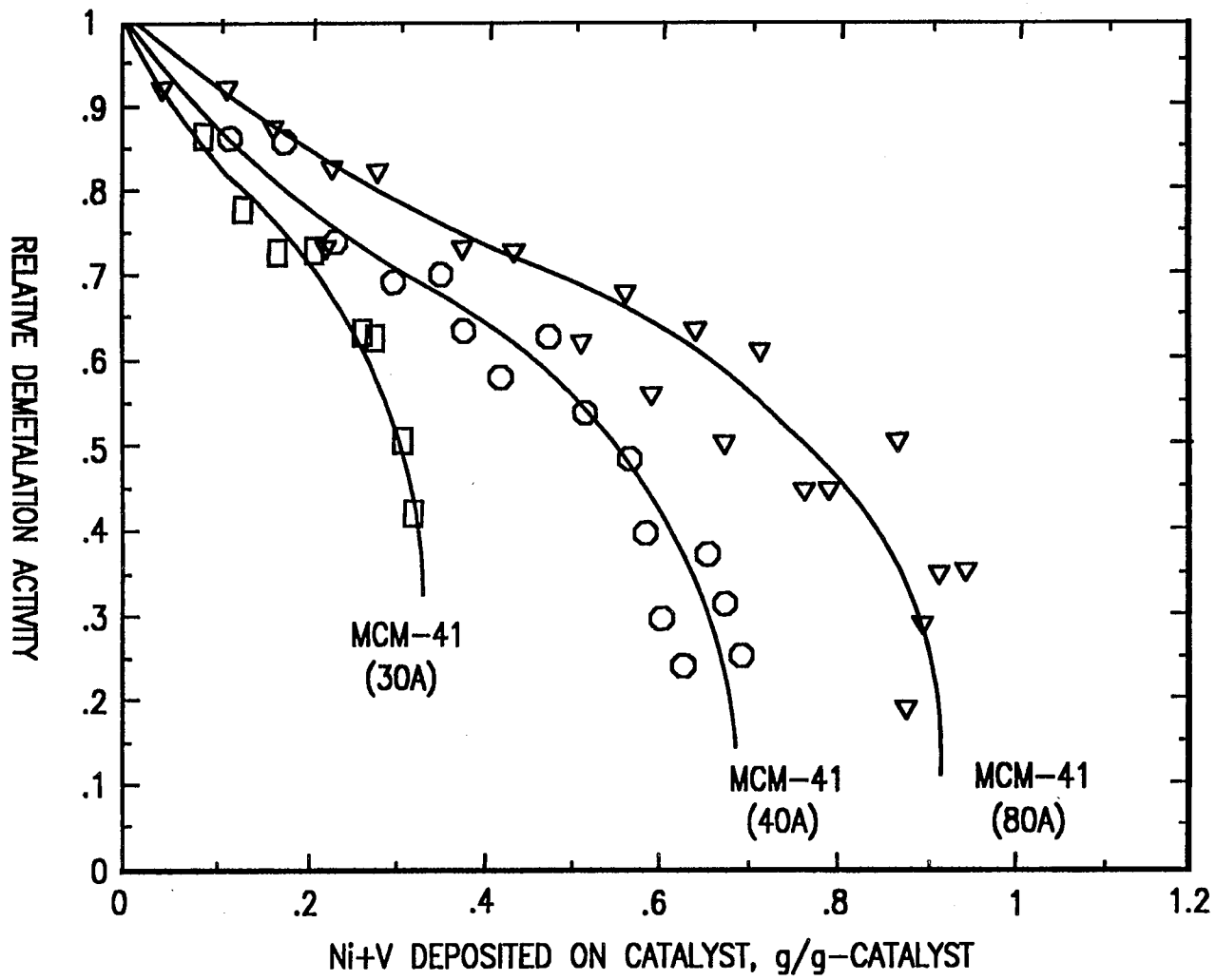
FIG. 2 is a plot showing the effect of metals deposition on demetalation.
Figure 3:
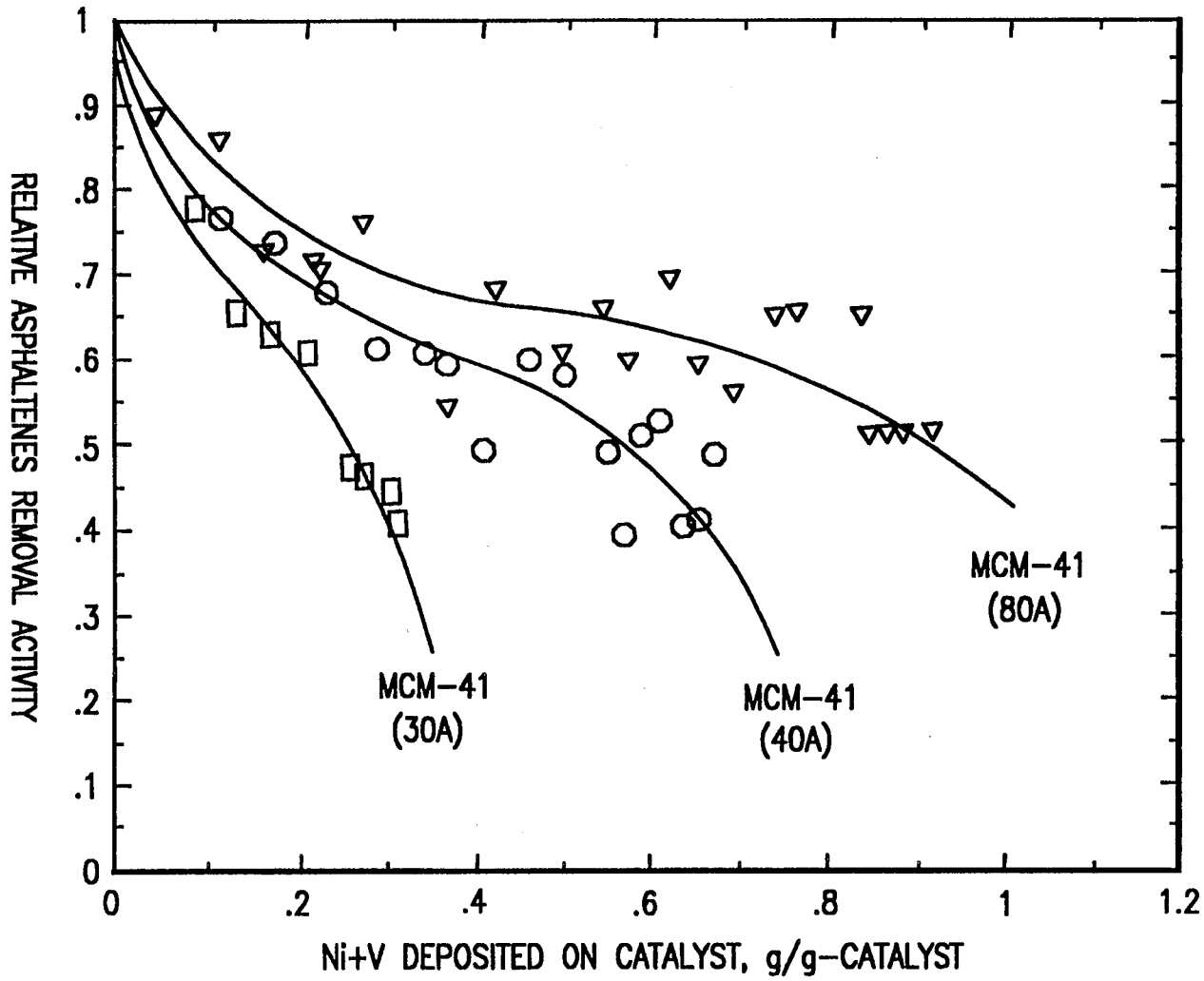
FIG. 3 is a plot showing the effect of metals deposition on asphaltenes conversion.

The effect (tolerance) of metals deposition on desulfurization, demetalation and asphaltenes conversion are shown in FIGS. 1, 2, and 3, respectively. The relative activity in these figures is defined as the ratio of the catalyst activity to its initial activity extrapolated at zero metals deposition. The relative activity was equivalent to the fraction of the initial catalyst activity that remained at any specific metals deposition. As shown in FIGS. 1, 2 and 3 capacity (tolerance) of the metals deposition increased with the pore size (d-spacing) of the MCM-41 materials. Since metals deposited can cause permanent deactivation to catalysts, it is desirable to place MCM-41 catalysts with a very high capacity for the metals deposition, i.e., the MCM-41(80 Angstroms) catalyst, at the top of the reactor to utilize its high capacity (tolerance) to store nickel and vanadium removed from the resid and protect other MCM-41 catalysts. Other trace metals, such as iron, sodium and calcium were also removed and deposited on the catalyst.

Changes and modifications in the specifically described embodiments can be carried out without departing from the scope of the invention which is intended to be limited only by the scope of the appended claims.

We claim:

1. A process for upgrading a hydrocarbon feedstock, said process comprising contacting said hydrocarbon feedstock with a catalyst under hydrogen pressure of at least about 2860 kPa in a first reaction zone, said catalyst comprising at least one Group VIA or Group VIII metal and an inorganic, porous crystalline phase material having, after calcination, an X-ray diffraction pattern with at least one peak at a d-spacing greater than about 18 Angstrom Units with a relative intensity of 100 and a benzene adsorption capacity of greater than 15 grams benzene per 100 grams of said material at 50 torr and 25° C., wherein said material has a pore size in the range of about 40 to about 120 Angstroms; and contacting the effluent from said first reaction zone with a catalyst in a second reaction zone said catalyst comprising at least one Group VIA or Group VIII metal and an inorganic, porous crystalline phase material having, after calcination, an X-ray diffraction pattern with at least one peak at a d-spacing greater than about 18 Angstrom Units with a relative intensity of 100 and a benzene adsorption capacity of greater than 15 grams benzene per 100 grams of said material at 50 torr and 25° C., and wherein said material has a pore size in the range of less than about 60 Angstroms.

2. A process for upgrading a hydrocarbon feedstock, said process comprising contacting said hydrocarbon feedstock with a catalyst under hydrogen pressure of at least about 2860 kPa in a first reaction zone, said catalyst comprising at least one Group VIA or Group VIII metal and an inorganic, porous crystalline phase material having, after calcination, an X-ray diffraction pattern with at least one peak at a d-spacing greater than about 18 Angstrom Units with a relative intensity of 100 and a benzene adsorption capacity of greater than 15 grams benzene per 100 grams of said material at 50 torr and 25° C., wherein said material has a pore size in the range of about 60 to about 120 Angstroms;

contacting the effluent from said first reaction zone with a catalyst in a second reaction zone said catalyst comprising at least one Group VIA or Group VIII metal and an inorganic, porous crystalline phase material having, after calcination, an X-ray diffraction pattern with at least one peak at a d-spacing greater than about 18 Angstrom Units with a relative intensity of 100 and a benzene adsorption capacity of greater than 15 grams benzene per 100 grams of said material at 50 torr and 25° C., and wherein said material has a pore size in the range of about 40 to less than about 60 Angstroms; and contacting the effluent from said second reaction zone with a catalyst in a third reaction zone said catalyst comprising at least one Group VIA of Group VIII metal and an inorganic, porous crystalline phase material having, after calcination, an X-ray diffraction pattern with at least one peak at a d-spacing greater than about 18 Angstrom Units with a relative intensity of 100 and a benzene adsorption capacity of greater than 15 grams benzene per 100 grams of said material at 50 torr and 25° C., and wherein said material has a pore size of in the range of about 20 to less than about 40 Angstroms.

3. The process according to claim 2 wherein said at least one Group VIA or Group VIII metal is selected from the group consisting of molybdenum, cobalt, nickel or any combination thereof.

4. The process according to claim 2 wherein said first reaction zone, said second reaction zone and said third reaction zone are in the same reactor.

5. The process according to claim 2 wherein said first reaction zone, said second reaction zone and said third reaction zone are in separate reactors in series.

6. The process according to claim 2 wherein said hydrocarbon feedstock is contacted with a catalyst in more than three reaction zones.

7. The process according to claim 2, wherein said process is operated at a temperature between about 260° C. and 455° C. and a liquid hourly space velocity between about 0.1 and 10 $hr^{-1}$.

8. The process according to claim 2, wherein said feedstock is substantially composed of hydrocarbons boiling above 340° C.

9. The process according to claim 8, wherein said feedstock is an atmospheric resid.

10. The process according to claim 2 wherein said feedstock is shale oil.

11. A process for upgrading a hydrocarbon feedstock, said process comprising contacting said hydrocarbon feedstock with a catalyst under hydrogen pressure of at least about 2860 kPa in a first reaction zone, said catalyst comprising at least one Group VIA or Group VIII metal and a zeolite having the structure of MCM-41, wherein said zeolite having the structure of MCM-41 has a pore size in the range of about 60 to about 120 Angstroms;

contacting the effluent from said first reaction zone with a catalyst in a second reaction zone said catalyst comprising at least one Group VIA or Group VIII metal and a zeolite having the structure of MCM-41, wherein said zeolite having the structure of MCM-41 has a pore size in the range of about 40 to less than about 60 Angstroms; and contacting the effluent from said second reaction zone with a catalyst in a third reaction zone said catalyst comprising at least one Group VIA or Group VIII metal and a zeolite having the structure of MCM-41, wherein said zeolite having the structure of MCM-41 has a pore size of in the range of about 20 to less than about 40 Angstroms.

12. The process according to claim 11 wherein said at least one Group VIA or Group VIII metal is selected from the group consisting of molybdenum, cobalt, nickel or any combination thereof.

13. The process according to claim 11 wherein said first reaction zone, said second relation zone and said third reaction zone are in the same reactor.

14. The process according to claim 11 wherein said first reaction zone, said second reaction zone and said third reaction zone are in separate reactors in series.

15. The process according to claim 11 wherein said hydrocarbon feedstock is contacted with a catalyst in more than three reaction zones.

16. The process according to claim 11 wherein said process is operated at a temperature between about 260° C. and 455° C. and a liquid hourly space velocity between about 0.1 and 10 $hr^{-1}$.

17. The process according to claim 11 wherein said feedstock is substantially composed of hydrocarbons boiling above 340° C.

18. The process according to claim 17, wherein said feedstock is an atmospheric resid.

19. The process according to claim 11 wherein said feedstock is shale oil.

* * * * *

UNITED STATES PATENT AND TRADEMARK OFFICE

CERTIFICATE OF CORRECTION

PATENT NO. : 5,344,553

DATED : September 6, 1994

INVENTOR(S) : Stuart S. Shih

It is certified that error appears in the above-indentified patent and that said Letters Patent is hereby corrected as shown below:

Col. 23, line 16, Claim 1, delete "40" and insert --60--.

Col. 24, line 49, Claim 13, delete "relation" and insert --reaction--.

Signed and Sealed this

Sixth Day of December, 1994

*Attest:*

Bruce Lehman

BRUCE LEHMAN

*Attesting Officer*

*Commissioner of Patents and Trademarks*